United States Patent [19]

Shapland

[11] Patent Number: 4,573,616

[45] Date of Patent: Mar. 4, 1986

[54] VALVE, CLAMP, REFRACTORY AND METHOD

[75] Inventor: Earl P. Shapland, Sarasota, Fla.

[73] Assignee: Flo-Con Systems, Inc., Champaign, Ill.

[21] Appl. No.: 622,235

[22] Filed: Jun. 19, 1984

Related U.S. Application Data

[63] Continuation-in-part of Ser. No. 381,063, May 24, 1982.

[51] Int. Cl.[4] ..... B22D 37/00; B22D 41/08

[52] U.S. Cl. ..... 222/600; 222/591; 251/326

[58] Field of Search ..... 222/600, 512, 561, 598, 222/591, 164, 606, 607; 251/349, 326, 353, 176; 137/242

[56] References Cited

U.S. PATENT DOCUMENTS

| | | | |
|---|---|---|---|
| 3,395,840 | 8/1968 | Gardner | 222/591 |
| 3,931,913 | 1/1976 | Meier | 222/561 X |
| 4,056,217 | 11/1977 | Aliprandi et al. | 222/512 X |
| 4,116,372 | 9/1978 | Horiguchi et al. | 222/512 X |
| 4,365,731 | 12/1982 | Fehling et al. | 222/600 |

FOREIGN PATENT DOCUMENTS

| | | | |
|---|---|---|---|
| 0040340 | 11/1981 | | 222/594 |
| 6000540 | 1/1976 | Japan | 222/600 |
| 0374454 | 3/1964 | Switzerland | 222/600 |
| 1380121 | 1/1975 | United Kingdom | 222/601 |

*Primary Examiner*—Joseph J. Rolla
*Assistant Examiner*—Nils E. Pedersen
*Attorney, Agent, or Firm*—Jack E. Dominik

[57] ABSTRACT

Disclosed is a valve and refractory construction in which the stationary plate and the sliding gate are of a bandless refractory. Similarly the lower nozzle, and collector nozzle are also bandless, along with the optional collector tip. Various refractory shapes are contemplated, but primarily a shape with a tapered face on the edge of the refractories, and which are engaged by clamps having a mating tapered face. The refractory can also be made in a single form for both the stationary plate and the sliding gate. All of the refractories are clamped in place by clamping members having tapered faces which engage the tapered faces or edges of the refractory. The nozzles are similarly engaged, but by an encircling support and clamp.

23 Claims, 12 Drawing Figures

FIG. 10
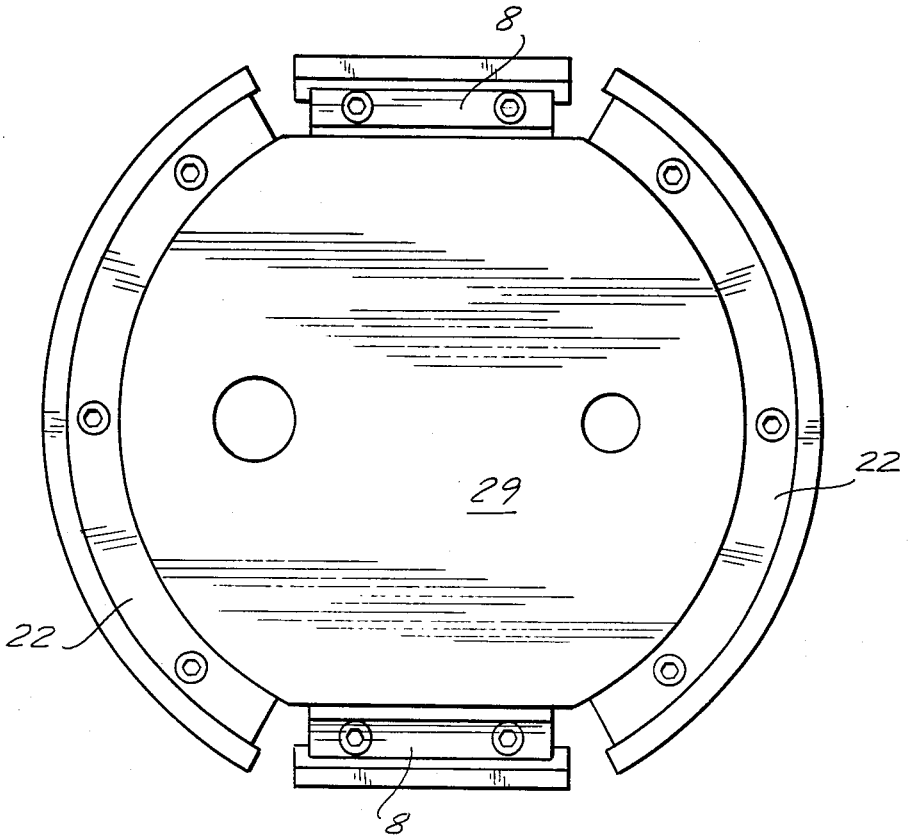
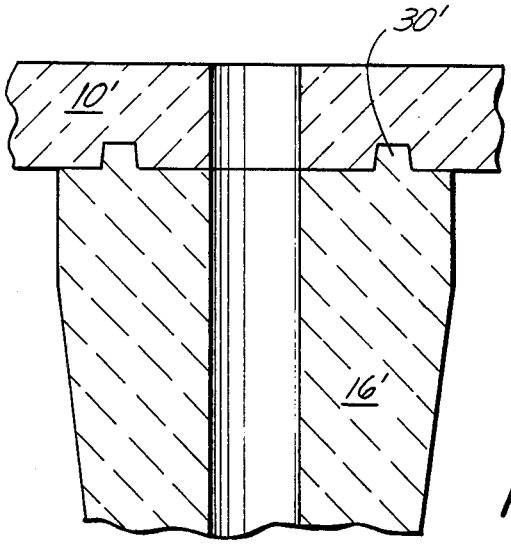
FIG. 12

VALVE, CLAMP, REFRACTORY AND METHOD

RELATED APPLICATIONS

This application is a continuation-in-part of application Ser No. 381,063 filed May 24, 1982 by the same inventor herein and entitled "PRESSURE FLUID TEEMING VALVE AND METHOD."

FIELD OF THE INVENTION

The present invention relates primarily to a sliding gate valve, clamp, refractory, and method useful in controlling the teeming of fluids, and more particularly metals such as iron steel. The same are exemplified in Shapland and Shapland U.S. Pat. No. 4,063,668.

BACKGROUND OF THE INVENTION

In the earlier valves of the variety of Lewis U.S. Pat. No. 311,902, and including the Interstop and Metacon valves of today as exemplified by U.S. Pat. No. 4,063,668, the fixed and sliding refractory components are mortar bonded into metal components. The engineering philosophy is that during operation the refractory components are held in an abutting relationship as well as in vertical and lateral compression to prevent fracture of the refractory plates. Even if minor fracture occurs, the compression provided by the metal encasement is intended to avoid "break-out" of the liquid metal.

In the early sliding gate valves of the variety covered by the subject Shapland et al patent, springs are used to apply the abutting and vertical compression force. In such valve constructions, the stationary and sliding refractory plates are mortar bonded into light weight metal stampings which encase the refractory on all but the abutting faces. The metal encasement serves to assist in distributing the spring pressure of the bottom of the refractory plates and to contain the plates laterally. In some modification of this type of valve, a metal or combination metal and compressible refractory fiber plate is used to distribute the spring pressure over the bottom of the refractory. A band tensioned and clamped or a band welded and then shrunk around the periphery of the plates are used to contain and compress the refractory laterally.

With the valves of the prior art, and more particularly the refractory of the prior art, efforts have invariably been made to insure planarity of the faces of the refractory. Oftentimes this incurs expensive forming steps including the grinding of the faces. Furthermore, with the refractory encased in a metal container, even though perfect planarity may exist in the refractory, this can be impaired when a refractory is "mortared" into the metal container. In addition, when the refractories are contained or metal encased, oftentimes large sections of fired refractory are employed which are significantly more expensive than a monolithic type refractory which can be cast.

In the manufacture of steel, various elements of cost go into the price per ton. This includes the cost of operating sliding gate valves. It therefore becomes desirable to develop a sliding gate valve which maximizes the number of heats which the refractory can accommodate, minimizes the cost of the refractory, and utilizes the same in a valve construction at an omptimized investment cost. The amount of time the valve requires for change of refractory, the make-up time, and the inherent cost of the refractory must all be considered in addition to the safety of the valve in minimizing breakout.

SUMMARY OF THE INVENTION

The present invention is directed to a valve and refractory construction in which the stationary plate and the sliding gate are of a bandless refractory. Similarly the lower nozzle, and collector nozzle are also bandless, along with the optional collector tip. Various refractory shapes are contemplated, but primarily a shape with a tapered face on the edge of the refractories, and which are engaged by clamps having a mating tapered face. The refractory can also be made in a single form for both the stationary plate and the sliding gate. All of the refractories are clamped in place by clamping members having tapered faces which engage the tapered faces or edges of the refractory. The nozzles are similarly engaged, but by an encircling support and clamp.

In view of the foregoing it is a principal object of the present invention to provide a valve construction having a clamp assembly which can compressively and lockingly engage a bandless refractory.

A related object of the present invention is to provide one form of stationary plate and slide gate plate which are identical, thereby reducing inventory problems and effecting economies in manufacture.

Yet another object of the present invention is to provide a bandless refractory which can optionally be cast of a monolithic material with erosion-resistant inserts at the orifice portion.

BRIEF DESCRIPTION OF THE DRAWINGS

Further objects and advantages of the present invention will become apparent as the following description of an illustrative embodiment proceeds, taken in conjunction with the accompanying drawings, in which:

FIG. 10 is another alternative plate intended for use with a rotary valve;

FIG. 12 is an enlarged view through the collector nozzle and the sliding gate plate showing the alternative embodiment in FIG. 11.

DESCRIPTION OF PREFERRED EMBODIMENTS

Figure 1:
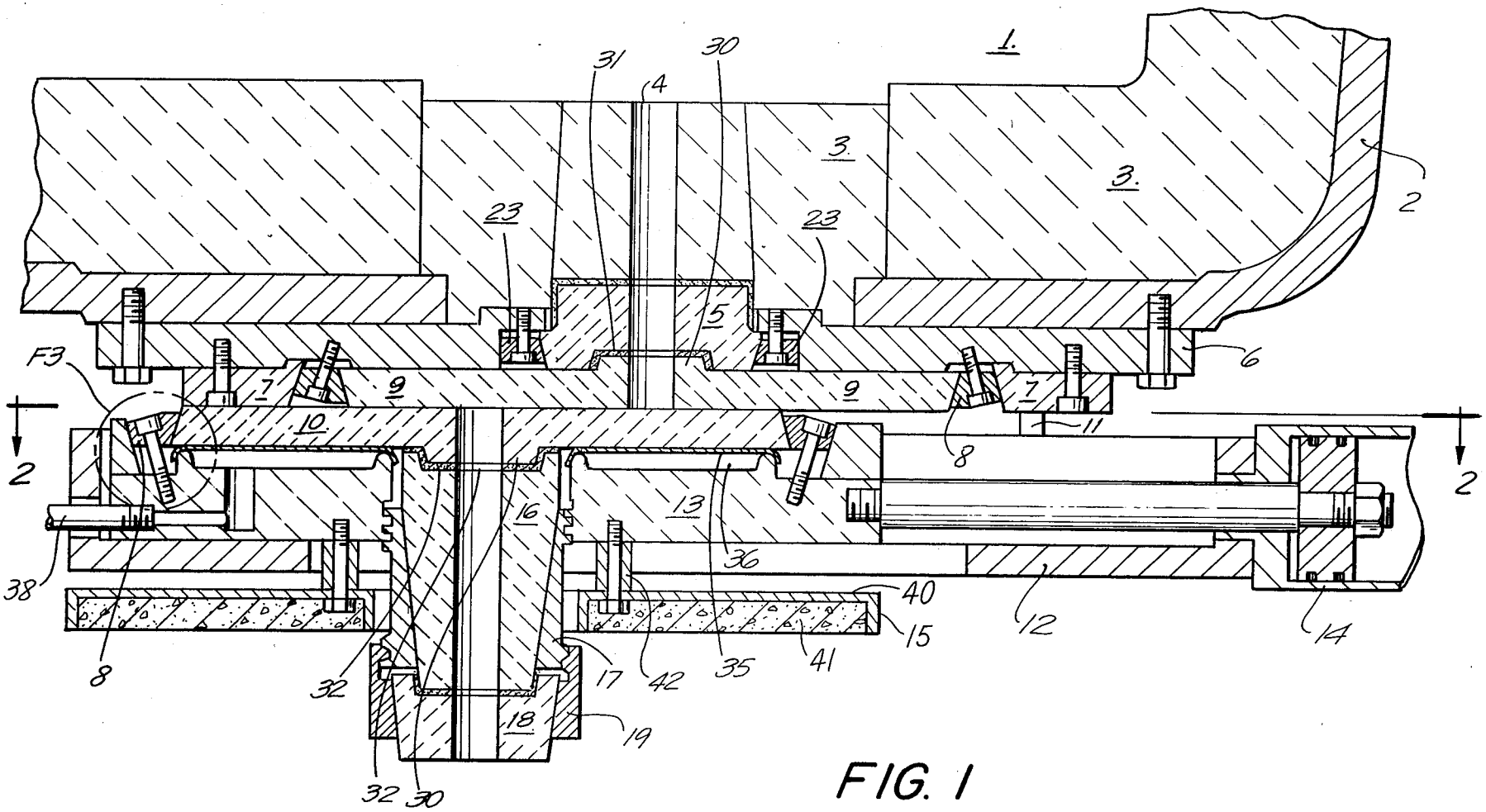
FIG. 1 is a longitudinal sectional view of a teeming vessel and the illustrative valve taken along section line 1—1 in FIG. 2.
Figure 2:
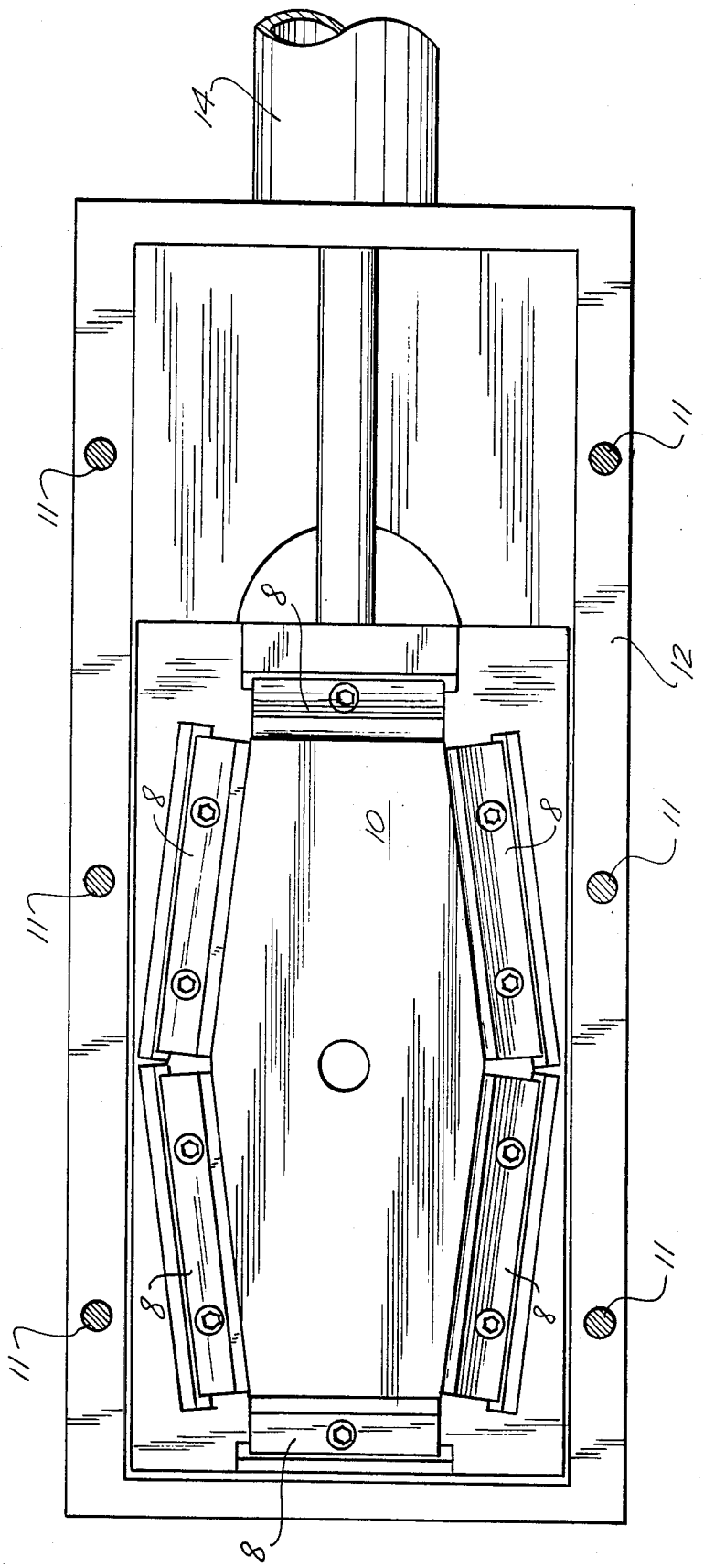
FIG. 2 is a horizontal downward section taken along section line 2—2 of FIG. 1.

Turning now to FIG. 1, it will be seen that the ladle or teeming vessel 1 has a metal shell 2 with a refractory lining 3. A teeming orifice 4 is provided centrally in the refractory lining 3, and protects the metal shell 2 from the molten material being teemed. The lower portion of the ladle orifice is formed by a replaceable lower ladle nozzle 5 secured into the valve mounting plate 6 by means of the clamp 23. The mounting plate 6, in turn, is normally bolted to the ladle metal shell 2.

Secured to the valve mounting plate 6 are metal stationary plate clamp backing blocks 7, which back up the stationary plate clamps 8 that restrain and clamp the stationary refractory plate 9 and also serve to prevent upward displacement of the end of the movable refractory plate 10 when it is extended beyond the limits of the stationary refractory plate 9.

Suspended below the valve mounting plate 6 by a frame suspension 11, is the valve frame 12. The valve frame 12, in turn, contains and supports the movable refractory plate carrier 13. The carrier 13 is activated by power mechanism 14 shown here as an hydraulic drive. Also to be noted is provision for a heat and splatter shield 15. The splatter shield 15 is suspended below the movable refractory plate 10, as is the refractory collector nozzle 16 which is supported and restrained by a collector nozzle clamp 17 threadedly engaged into the movable refractory plate carrier 13.

Optionally below the refractory collector nozzle 16 is a refractory collector tip 18. The collector tip is supported and restrained by the collector tip clamp 19 which is threadedly engaged onto the collector nozzle clamp 17.

Figure 3:
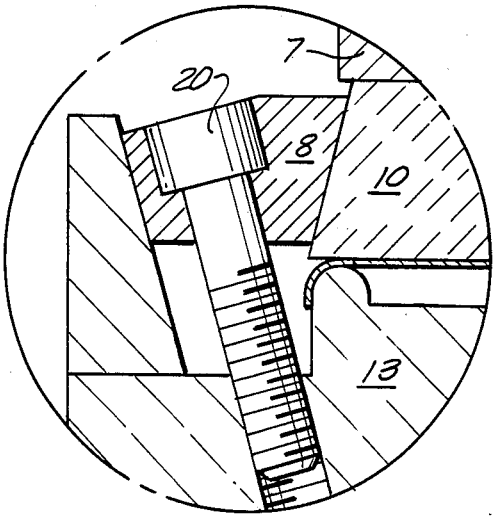
FIG. 3 is an enlarged view of a portion of the cross-section of FIG. 1 taken at F3 on FIG. 1.

Turning now to FIG. 3, the view shows the refractory plate clamp 8 and its screw 20 as it is used to clamp the removable refractory plate 10 to the yieldable diaphragm type carrier 13. At the same time, it also restrains the removable refractory plate against thermal expansion and constantly maintains the material of the removable refractory plate and compression.

Figure 4:
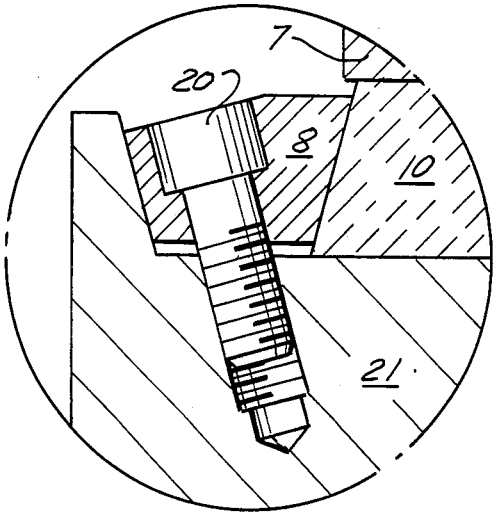
FIG. 4 is an alternative embodiment showing the same view of the same location but in which the plate is non-yieldably secured to the carrier.

FIG. 4 is comparable to FIG. 3 as to the area of the plate where located, but it shows the refractory plate clamp 8 as it applies pressure to the refractory plate supported by a removable carrier 21 of the non-yieldable support type.

Figure 5:
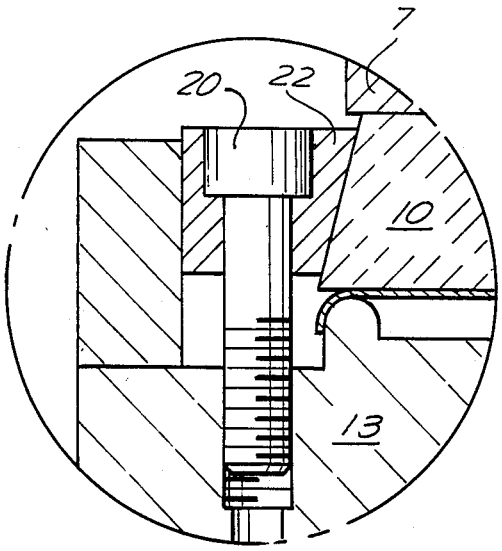
FIG. 5 is an alternative of FIG. 3, but showing the clamp screw perpendicular to the carrier.
Figure 8:
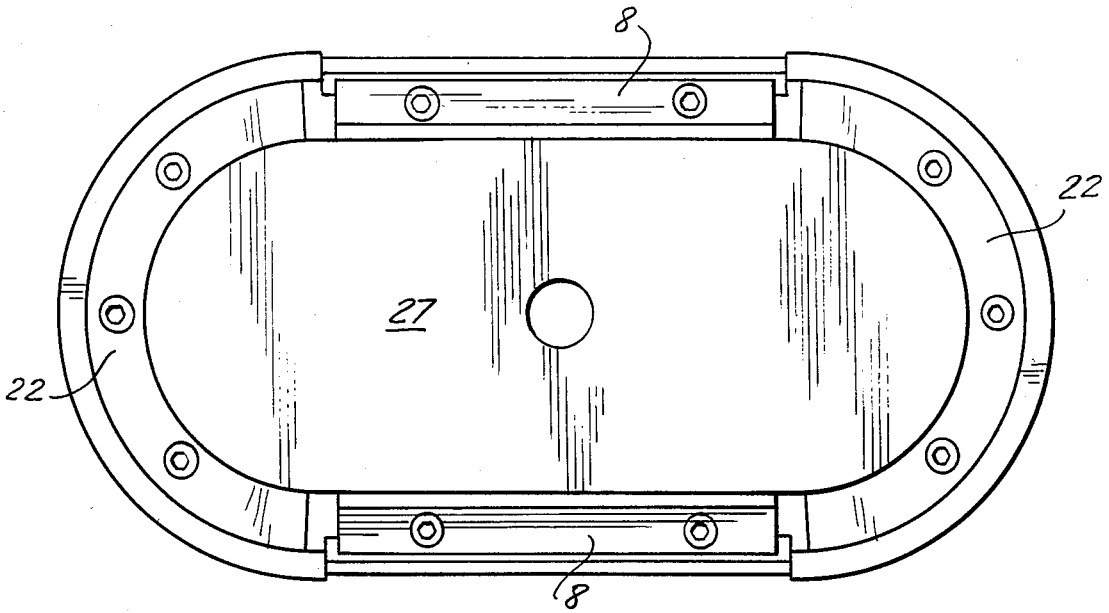
FIG. 8 is an alternative view of a sliding gate and a stationary plate with an obround plate and clamps.
Figure 9:
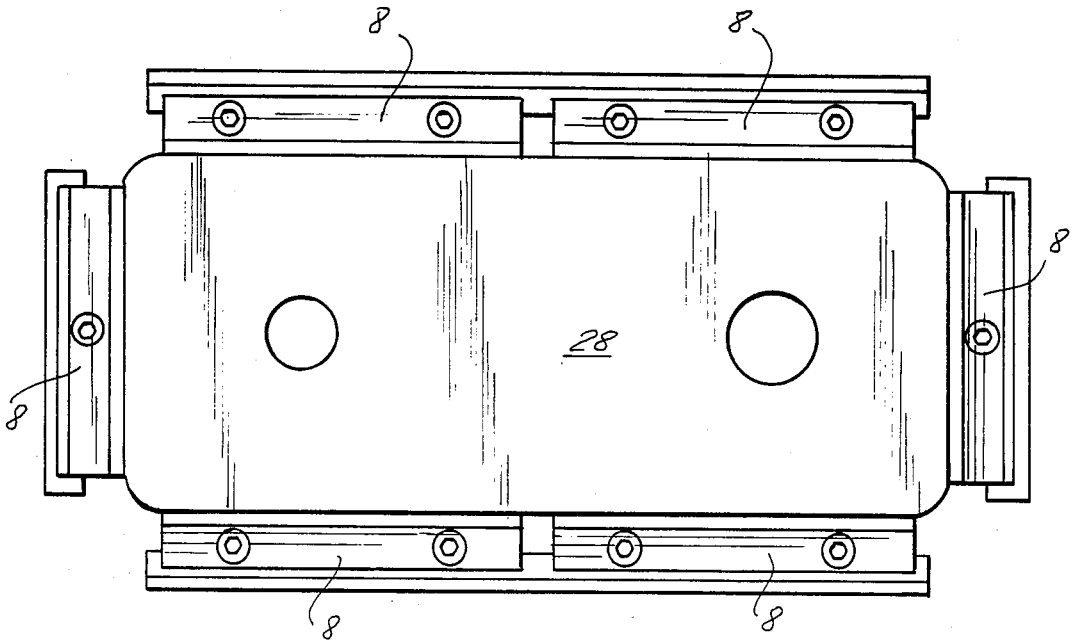
FIG. 9 is yet another alternative showing a rectangular plate having two orifices.

FIG. 5 is a similar view of a further variation of the plate clamp 22, which travels in a direction perpendicular to the plate surface. Such a plate clamp can apply both a clamping and lateral restraining force to the refractory plate. Its disadvantage is that it must be completely removed when replacing the plate, while the plate clamp 8 of FIG. 3 which travels obliquely to the plate's surface can be backed off sufficiently to allow the plate replacement without complete removal. The type of plate clamp 22, however, is more effective when it is applied to the curved edge of a plate or nozzle as shown by the lower ladle nozzle clamp 23 of FIG. 1 and by the curved plate clamps 22 in FIGS. 8 and 10. The perpendicular clamp 22 is used for the curved configuration since if an oblique clamp is used, it would have to be flexible enough to accommodate a change in radius as the bolt 20 is tightened.

Figure 6:
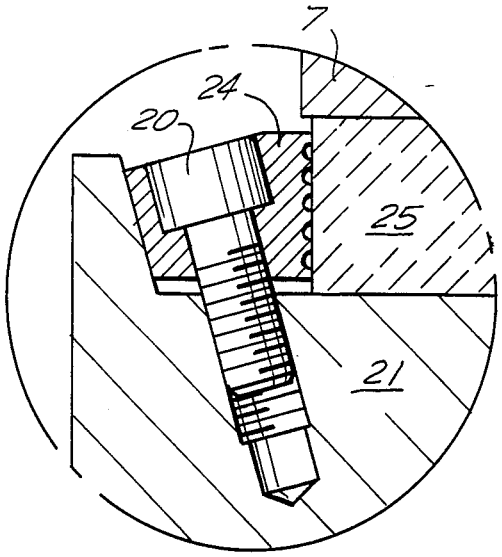
FIG. 6 is but another alternative in which the face of the refractory is not tapered.
Figure 7:
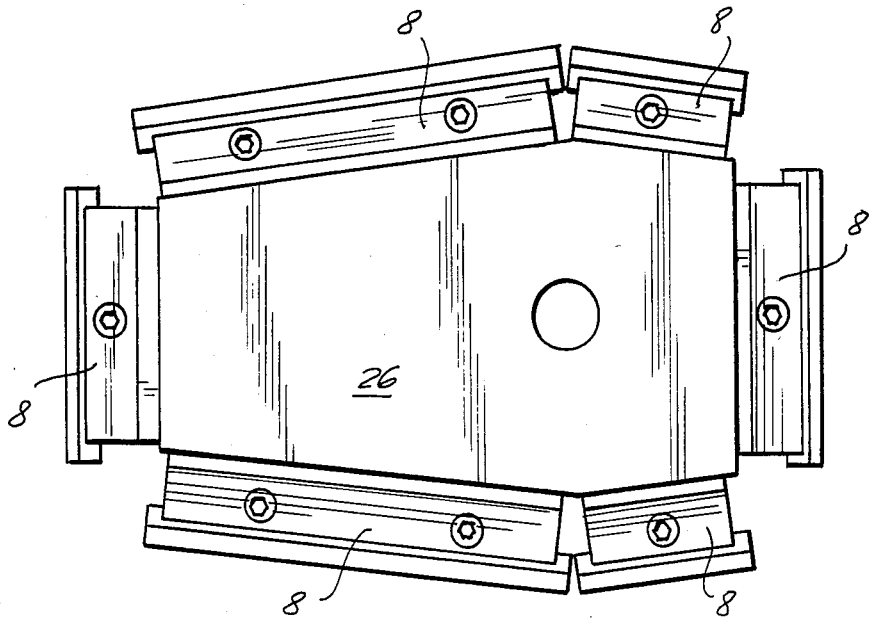
FIG. 7 is an alternative view of the sliding gate showing an asymmetrical construction.

FIG. 6 shows but another alternative with an oblique travelling, straight faced clamp 24, which restrains a non-tapered perpendicular edged refractory plate 25 and a movable carrier 21 of the non-yieldable support type. Such a clamp as this can supply an adequate lateral restraining force but can supply very little vertical clamping force. It is therefore more suitable to the non-yieldable type carrier.

The use of identical stationary plates 9 and sliding gates 10 results from a construction in which they respectively engage their upstream and downstream refractories in an identical manner. For example, as shown in FIG. 1 a junction boss is provided at the rear face of each of the plates, with the junction pocket of the lower nozzle 5 engaging the stationary plate in a mortared relationship. Similarly the junction pocket 32 of the collector nozzle 16 engages the junction boss 30 of the sliding plate 10.

As discussed previously, the valve environment shown is of the yieldable type. In the instance shown in FIG. 1, a diaphragm 35 is provided to cover the bulk of the area beneath the sliding refractory plate 10, with the diaphragm overlying a chamber 36 activated and held in constant yieldable engagement by means of pressure conduit 38 and an exterior source of gas.

The splatter shield 15 has a shield back 40 of metal, a shield refractory 41 desirably monolithically cast into the shield back 40, and is secured by means of shield mounts 42 to the carrier 13.

Figure 11:
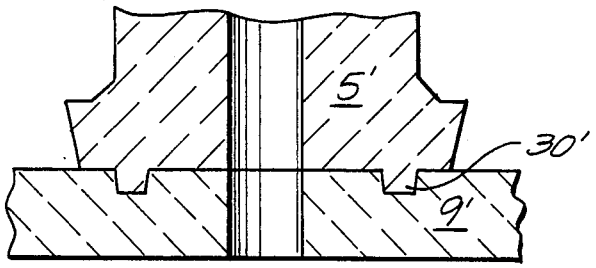
FIG. 11 is an enlarged view through the connection between the lower nozzle and the stationary plate showing an alternative means for joining the two.

In those instances where it is desired to grind the two faces of the plate, whether it is stationary 9 or sliding 10, are shown in FIGS. 11 and 12. There it will be seen that as to the stationary plate 9', which engages the lower nozzle 5', a tongue and groove joint 30' is provided. Similarly as shown in FIG. 12, the collector nozzle 16' engages the underneath portion of the sliding gate plate 10', by means of a similarly proportioned tongue and groove joint 30'.

As to the stationary plate 9, the sliding gate plate 10, and the collector nozzle and tip 16, 18, optimum angles are employed. They are essentially between 5° and 20° taper along the edges. Less than 5° will find a significantly reduced clamping effort as well as centrally compressive effort. When the angle increases 45°, the effort is almost 100% clamping to the exclusion of compression. In the instance where the collector nozzle 16 is engaged by the collector nozzle clamp 17, the angularity may be at the lower end of the range from 5° to 20°. On the other hand with the stationary plate 9 and the sliding gate plate 10, this configuration has an average angle of perhaps 7° to 15°, but within the range of 5° to 20° in order to optimize the centrally compressive force with the downward clamping effort. In addition, since the stationary plate 9 is stationary, somewhat less of a clamping effort is required. On the other hand, the frictional forces attending to dislodge the stationary plate 10 are such that a greater clamping effort is required.

In utilizing the method of the present invention, refractory plates both stationary 9 and sliding 10 are clampingly engaged to their respective support members by means of a compressive force which both secures the same into position, and provides a centrally directed force component to compress the refractory. The refractories are desirably identical, that is the stationary plate 9 and the sliding gate 10. By supplying the user with identical plates, a smaller inventory can be employed, and the matching of the two plates more readily predictable.

Although particular embodiments of the invention have been shown and described in full here, there is no intention to thereby limit the invention to the details of such embodiments. On the contrary, the intention is to cover all modifications, alternatives, embodiments, usages and equivalents of the subject invention as fall within the spirit and scope of the invention, specification, and the appended claims.

What is claimed is:

1. A refractory plate for use with a sliding gate valve comprising a refractory slab having opposite faces, one face being a sliding face and one face being a mounting face, said slab having edge portions between the opposite faces, at least two opposed edge portions being tapered, said slab width and length enlarging progressively from the sliding face towards the mounting face along substantially the entire extent of the tapered edge portions, said taper permitting central and mounting compressive forces on the edges when engaged by a clamp having a mating tapered face.

2. In the refractory plate of claim 1 above, said edge portion taper being at an angle of 5° to 20° with an axis perpendicular to the two faces of the slab.

3. In the refractory plate of claim 1 above, a central circular boss on the face of said slab facing the mounting surface, said boss being proportioned to fit in a pocket on a nozzle.

4. In the refractory plate of claim 1 above, said plate being substantially rectangular.

5. In the refractory plate of claim 4 above, said rectangular portion having rounded corners.

6. In the refractory plate of claim 1 above, said refractory having a central orifice, said refractory plate having the configuration of a mirror imaged isosceles trapezoid on opposite sides of the orifice and defining two end edge portions, and four sidewall edge portions.

7. A well block nozzle in combination with the refractory of claim 1 above, said nozzle having a 5° to 20° taper portion on a collar at the downstream end of said nozzle, said nozzle having a ring portion at its other second end of a diameter smaller than the first end tapered portion.

8. In the well block nozzle of claim 7, an annular recessed pocket at the lower portion.

9. In the well block nozzle of claim 8, said pocket being formed to receive a boss in the stationary plate portion which abuts the well block nozzle.

10. A refractory plate for use in a sliding gate valve comprising a refractory slab having opposed edge ends and edge sides and a sliding face and a mounting face, one edge side having a tapered portion, one end edge having a tapered portion, said slab width and length enlarging progressively from the sliding face towards the mounting face along substantially the entire extent of the tapered edge portions, the angle of each face permitting an opposed clamping member to exert both central and downward pressure components, the downward component being directed against a support for the refractory.

11. In the refractory plate of claim 10 above, said tapered faces being at an angle of 5° to 20° with an axis perpendicular to the two faces of the slab.

12. In the refractory plate of claim 10 above, a central circular recess on the face of said slab opposite to the face having an interface with a like slab, said recess being proportioned to receive an upstanding ring on a collector nozzle.

13. A well block nozzle for use with the refractory plate of claim 12, said nozzle having a 5° to 20° taper on a lower collar, said nozzle having a ring portion at its upper portion remote from the lower collar of a diameter smaller than the lower tapered portion.

14. In the well block nozzle of claim 13, an annular pocket at the lower portion.

15. In the well block nozzle of claim 14, said annular recessed ring being formed to oppose a comparable annular recessed ring in the sliding plate which abuts a collector nozzle.

16. In the refractory plate of claim 10 above, said plating being substantially rectangular.

17. In the refractory plate of claim 16 above, said rectangular portion having rounded corners.

18. In the refractory plate of claim 10 above, said plate having the configuration of a mirror imaged isosceles trapezoid defining two end edge portions, four edge sidewall portions, and two additional sidewall portions on a rectangular orientation with the end wall portions.

19. The method of mounting refractory plates having a parallel sliding face and mounting face and tapered edge portions, said plates width and length enlarging progressively from the sliding face towards the mounting face along substantially the entire extent of the tapered edge portions, in a sliding gate valve comprising the steps of tapering opposed edges of the refractory plates, clamping the tapered edges of the refractory plates with central and mounting pressure components, positioning said plates within a clamping peripheral engagement.

20. The method of mounting plates of claim 19, in a sliding gate valve wherein an edge compound compressive and clamping force is applied to the refractory plate while insertion of the plate into the valve to limit its movement or movement of any of its parts upon becoming fractured in use.

21. In the method of mounting refractory plates of claim 19 in a sliding gate valve for opposed relative sliding face to face compressive engagement the improved step of applying edge compressive force to the refractory plates upon installations in the valve, and maintaining said edge compressive force on the refractory plates throughout the usage of the valve.

22. A sliding gate valve for use with a bandless refractory, said valve having a stationary plate and a sliding gate, a carrier for moving the sliding gate, a frame for receiving the carrier, means for driving the carrier, and yieldable means for urging the sliding plate in pressure face-to-face relationship with the stationary plate, said stationary plate and sliding gate each having opposite faces, one face being a sliding face and one face being a mounting face, said plates having edge portions, at least two edge portions being tapered, said plates having a width and length enlarging progressively from the tapered edge portions in the direction of the mounting face and away from the sliding face along substantially the entire extent of the tapered edge portions, characterized by tapered clamping means for engaging said tapered edge portions of said plates, means for engaging said clamping means and urging the same in a direction opposite from the sliding face, whereby a central compressive force component and a clamping component are developed as the engaging means engage the clamping means.

23. In the valve of claim 22 above, said clamping means being angled with the plane of the sliding face and towards the mounting face.

* * * * *